US005279410A

United States Patent [19]

Arashima et al.

[11] Patent Number: 5,279,410

[45] Date of Patent: Jan. 18, 1994

[54] PACKAGE FOR INK JET CARTRIDGE

[75] Inventors: Teruo Arashima, Kawasaki; Seiichiro Karita, Yokohama; Masahiko Higuma, Tohgane, all of Japan

[73] Assignee: Canon Kabushiki Kaisha, Tokyo, Japan

[21] Appl. No.: 912,710

[22] Filed: Jul. 13, 1992

[30] Foreign Application Priority Data

Jul. 15, 1991 [JP] Japan ..... 3-173958

[51] Int. Cl.[5] ..... B65D 25/22

[52] U.S. Cl. ..... 206/45.14; 206/328; 206/334; 206/461; 206/467

[58] Field of Search ..... 206/45.14, 45.19, 328, 206/334, 461–469, 470, 471, 524.2, 524.3, 806

[56] References Cited

U.S. PATENT DOCUMENTS

| | | | |
|---|---|---|---|
| 3,313,407 | 4/1967 | Palm, Jr. | 206/461 |
| 4,003,516 | 1/1977 | Commerford et al. | 229/51 SC |
| 4,146,128 | 3/1979 | Hogg et al. | 206/806 |
| 4,309,466 | 1/1982 | Stillman | 206/524.2 |
| 5,002,187 | 3/1991 | Rysner et al. | 206/461 |
| 5,027,947 | 7/1991 | Reighart | 206/806 |
| 5,074,418 | 12/1991 | Buan | 206/471 |
| 5,076,432 | 12/1991 | Wolf et al. | 206/806 |
| 5,105,939 | 4/1992 | Ralston, Jr. | 206/468 |
| 5,131,539 | 7/1992 | Karita et al. | 206/462 |

FOREIGN PATENT DOCUMENTS

| | | | |
|---|---|---|---|
| 0378241 | 7/1990 | European Pat. Off. . | |
| 3-111271 | 5/1991 | Japan | 206/334 |
| 0162263 | 7/1991 | Japan | 206/334 |
| 9013494 | 11/1990 | PCT Int'l Appl. | 206/471 |
| 0992497 | 5/1965 | United Kingdom | 206/461 |

*Primary Examiner*—Jimmy G. Foster

*Attorney, Agent, or Firm*—Fitzpatrick, Cella, Harper & Scinto

[57] ABSTRACT

A package for an ink jet cartridge includes an opaque casing having an accommodating portion for accommodating the ink cartridge; a covering member including an evaporated aluminum layer and a nylon layer for sealing of an access opening of the casing; and a box having a rectangular parallelepiped configuration for accommodating the casing sealed by the covering member, the box being provided with an opening portion and a hook for display.

3 Claims, 4 Drawing Sheets

FIG.2A
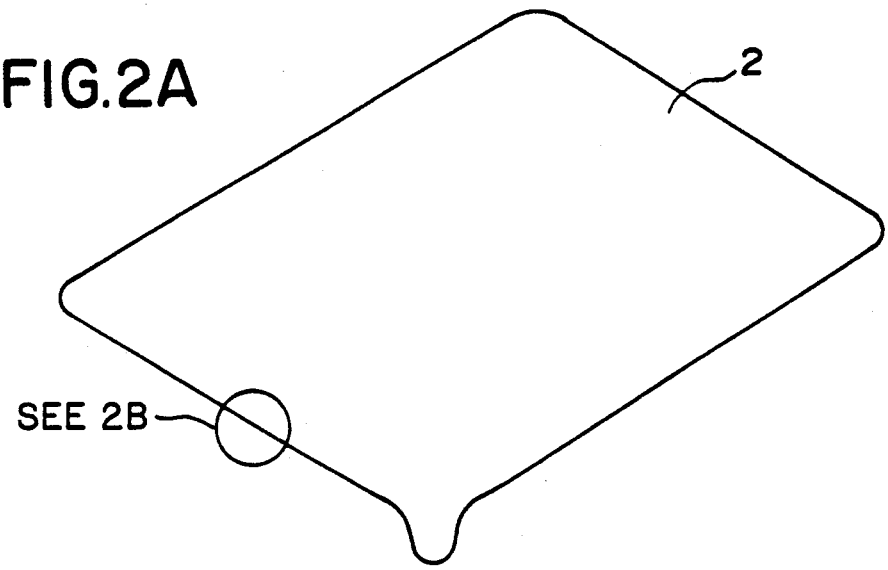
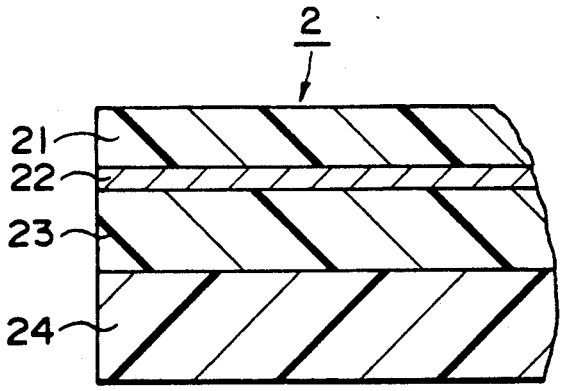
FIG.2B

PACKAGE FOR INK JET CARTRIDGE

FIELD OF THE INVENTION AND RELATED ART

The present invention relates to a package capable of effectively protecting the contents thereof from an external impact or variation change or the like.

Among various packages used for the purpose of protecting the contents thereof, the package for an ink jet cartridge is required to have an excellent durability against the external impact and the durability against the ambient condition change, the ink jet cartridge being usable with an ink jet recording apparatus in which liquid ink is ejected to effect the recording, the ink jet cartridge being detachably mountable to the ink jet recording apparatus. This is because the ink jet cartridge comprises a recording head having a very fine structure and an integral ink container containing the liquid ink to be supplied to the recording head. The liquid ink in the ink container may contain solvent component which may evaporate due to the ambient condition change or the like.

As a package for containing such an ink jet cartridge, the structure shown in FIG. 4 has been proposed in an application assigned to the assignee of this application. The accommodating package 40 comprises an accommodating casing 41 for accommodating an ink jet cartridge IJC and a covering member (not shown) for covering the casing 41, and an integral supporting member 43 for providing a display. The accommodating casing 41 of the package has a thickness of approximately 1 mm, and the material is a hard material, in order to assure the durability against impact thereto. The material thereof is substantially a transparent material to permit observance of the ink jet cartridge IJC contained therein. The cover has a six layer structure including a paper layer (72 microns thick), polyethylene layer (15 microns thick), an aluminum foil (7 microns thick), polyethylene terephthalate layer (15 microns thick), and an easy peel layer (25 microns thick), to effectively suppress transmittance of the ink component therethrough. The supporting member 43 comprises an opening facing to the casing 41 and a flat member to be engaged with the flange of the casing and is provided with a zipper for opening the package.

However, a problem has been found with such a package. Under a high temperature condition or the like, an ink component or components evaporated from the cartridge fill the inside space of the package. With further ambient condition change, the ink component may condense and adversely influence the recording head. In addition, the condensed component is deposited on the signal transmission electrode of the cartridge with the result of corrosion thereof.

Furthermore, the substantially transparent casing of the package may permit the daylight to be directly incident on the cartridge in the package. The daylight may adversely influence the ink or causes the ambient condition change within the package.

Additionally, for the purpose of durabilities against the impact and the ambient conditions change, the cost of the material used is expensive.

The supporting member has a portion sandwiching the flange of the casing with the aid of bonding agent. When the package is opened by peeling the bonded portion, the cartridge may receive the excessive impact with the liability of damage of the cartridge or the ink leakage therefrom.

SUMMARY OF THE INVENTION

Accordingly, it is a principal object of the present invention to provide a package for an ink jet cartridge having a necessary and sufficient durability against the external impact or the ambient condition change.

It is another object of the present invention to provide a package for an ink jet cartridge of low cost.

It is a further object of the present invention to provide a package for an ink jet cartridge which can be easily opened.

According to an aspect of the present invention, the casing and the covering member is thin and opaque or non-transparent, and they are contained in an opaque or non-transparent box so that during the opening action for the opaque accommodating box, there is no need of peeling a bonded portion.

According to an aspect of the present invention, there is provided a package for an ink jet cartridge, comprising: an opaque casing having an accommodating portion for accommodating the ink cartridge; a covering member including an evaporated aluminum layer and a nylon layer for sealing of an access opening of said casing; and a box having a rectangular parallelepiped configuration for accommodating said casing sealed by said covering member, said box being provided with an opening portion and a hook for display.

According to this invention, the sufficient durabilities against the external impact and the ambient condition change.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 2A and 2B are views of a covering member constituting the ink jet cartridge package.

DESCRIPTION OF THE PREFERRED EMBODIMENTS

Figure 1:
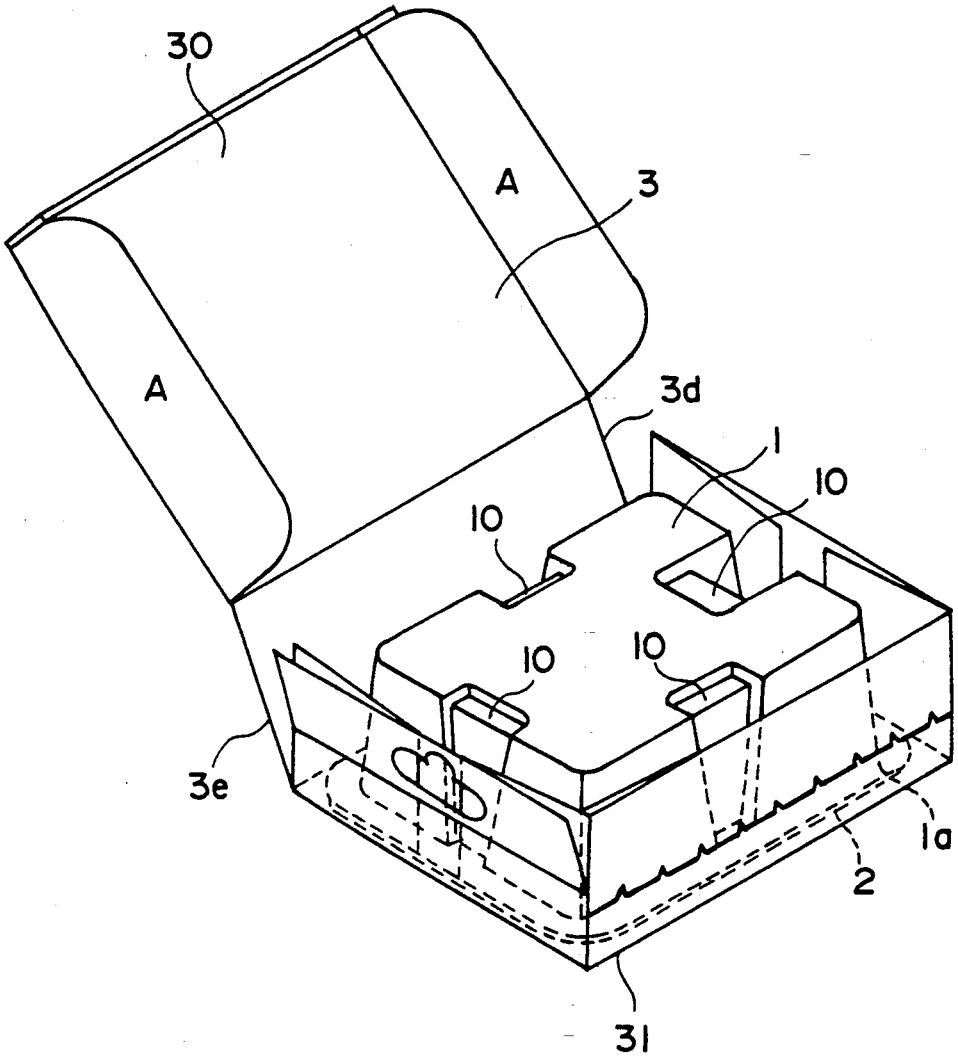
FIG. 1 is a perspective view of a package for an ink jet cartridge according to an embodiment of the present invention, wherein a box is opened.

Referring to FIG. 1, there is shown a package according to an embodiment of the present invention. It comprises an accommodating casing 1 for accommodating an ink jet cartridge (not shown), a covering member 2 for covering the accommodating casing 1 by being bonded to a flange 1*a* of an opening of the accommodating casing 1 for permitting the ink jet cartridge to be taken out.

In this embodiment, the casing 1 is made by injection molding. It is provided with recesses 10 at the four side surfaces. The recesses 10 provide projections into the accommodating space, which function to support and fix the ink jet cartridge in the accommodating space. Because of such a supporting, the ejection outlets of the cartridge are not required to be in direct contact with a wall surface of the casing 1. The recesses 10 are effective to support the cartridge with cushioning flexibility, thus preventing damage to the recording head due to the external impact. The accommodation casing 1 in this embodiment is made of opaque or non-transparent material to prevent transmittance of the day light into the inside space. Since the direct incidence of the sun light or ultraviolet rays are prevented, the adverse influence of the light or rays to the ink material and the adverse influence of the evaporated ink component on the signal transmitting electrodes or the like, can be prevented. The accommodation casing 1 is provided with the flange 1*a* to bond the covering member 2 thereto at the side having the opening.

In this embodiment, the accommodation casing 1 is made of polypropylene, for example, and has a thickness of 0.6 mm. The thickness permits proper transmittance of the evaporated component of the ink in the cartridge therethrough. If the thickness is too large, the transmittance of the evaporated component or components through the material, and therefore, the evaporated component is confined in the inside of the casing 1, with the result of the adverse influence on the electric contacts of the cartridge, more particularly, the corrosion or break due to the deposition of the water component. If it is too thin, the durability against the external impact decreases, with the result of insufficient function of protecting the inside cartridge. The thickness is determined in consideration of these factors. When the casing 1 is made of a material which will be described hereinafter, the usable thickness thereof is not less than 0.3 mm and not more than 1.0 mm, further preferably, not less than 0.5 mm and not more than 0.8 mm. However, the dimensions are exemplary, and it may be changed depending on the material used, different materials having a different composition ratio. Therefore, the proper thickness is selected by one skilled in the art in consideration of the required property or properties. The casing has only one half thickness as compared with the casing in the structure described in the introductory part of this specification, and therefore, the cost of the package can be reduced.

The usable materials for the casing 1 of this embodiment include, in addition to the polypropylene resin, an acrylnitrile-butadiene-styrene copolymer (ABS) resin, a polystyrene resin, a polyethylene resin, and a polyethylene terephthalate resin.

The covering member 2 for the casing 1 has a configuration covering the flange 1*a* of the casing 1 and is provided with a grip for facilitating peeling of the covering member 2 from the casing 1. In this embodiment, the covering member 2 has a laminated structure shown in FIG. 2B. More particularly, the covering member 2 has a four layer structure including a polyethylene terephthalate layer 21 (12 microns thick), an evaporated aluminum layer 22 (0.05 micron thick), a nylon layer 23 (25 microns thick), and CPP (cast polypropylene) layer 24 (30 microns thick), in the order named from the external side, that is, the side opposite from the bonding side relative to the casing 1. The total thickness is approximately 67 microns.

The thickness approximately one half the thickness of the covering member of the package discussed in the introductory part of this specification, which includes a paper layer (72 microns thick), a polyethylene layer (15 microns thick), aluminum foil layer (7 microns thick), polyethylene terephthalate layer (15 microns thick), a polyethylene layer (25 microns thick) and an EVA (ethylene vinyl acetate) (easy peel layer of 25 microns thick), the total layer being approximately 160 microns.

The main cause of the reduction of the thickness is the use of nylon and evaporated aluminum layer of the covering member. More particularly, the nylon layer has a high mechanical strength despite the small thickness thereof, and therefore, even if the thickness is about one half, the equivalent mechanical strength can be assured. The use of the evaporated aluminum layer permits a very thin layer as contrasted to the aluminum foil, thus permitting more penetration on transmission of the ink component to the outside. With the combination of the thin nylon and evaporated aluminum layers, the evaporated ink component in the casing 1, if any, can be transmitted more through the covering member of this embodiment.

Another embodiment will be described. In this embodiment, five layer structure is used. The covering member 2 of this embodiment comprises the polyethylene terephthalate layer of 12 microns thick, the evaporated aluminum layer of 0.05 micron thick, the nylon layer of 15 microns thick, the polyethylene layer of 25 microns thick and the EVA (ethylene vinyl acetate) layer of 25 microns thick, in the order named from the outside.

Three types of packages containing respective cartridges were prepared. One of them had the structure discussed in the introductory part of this specification. The other two were prepared in accordance with the first and second embodiments, respectively. They were kept for one week in a dry oven under the conditions of 60° C. and 20% of relative humidity. (This corresponds to the case in which they were kept for 2 years under the conditions of 25° C. and 50% of relative humidity.) The weights were compared. It has been confirmed that the evaporation of the ink in the case of the package of those embodiments is approx. 1.4 and 1.3 times evaporation in the case of the other. That is, the package of this embodiment has a proper penetrating property of the ink.

Thus, even if the ink component in the cartridge is evaporated due to the ambient condition change or the like to such an extent that the evaporated component is filled in the casing, the proper amount of the ink component is penetrated through the package to the outside thereof. Therefore, the adverse influence such as corrosion of the electric contacts or the like due to the condensed ink component as a result of the subsequent ambient condition change, can be decreased significantly. Then, the proper printing operation is possible after the package is opened.

The evaporated aluminum layer is effective to prevent light transmission while permitting a certain degree of transmitting of the evaporated component of the ink, and therefore, the adverse influence by the light can be sufficiently avoided.

The cost of the package can be reduced because the layer structure is simplified and because the thickness thereof is reduced.

Figure 3:
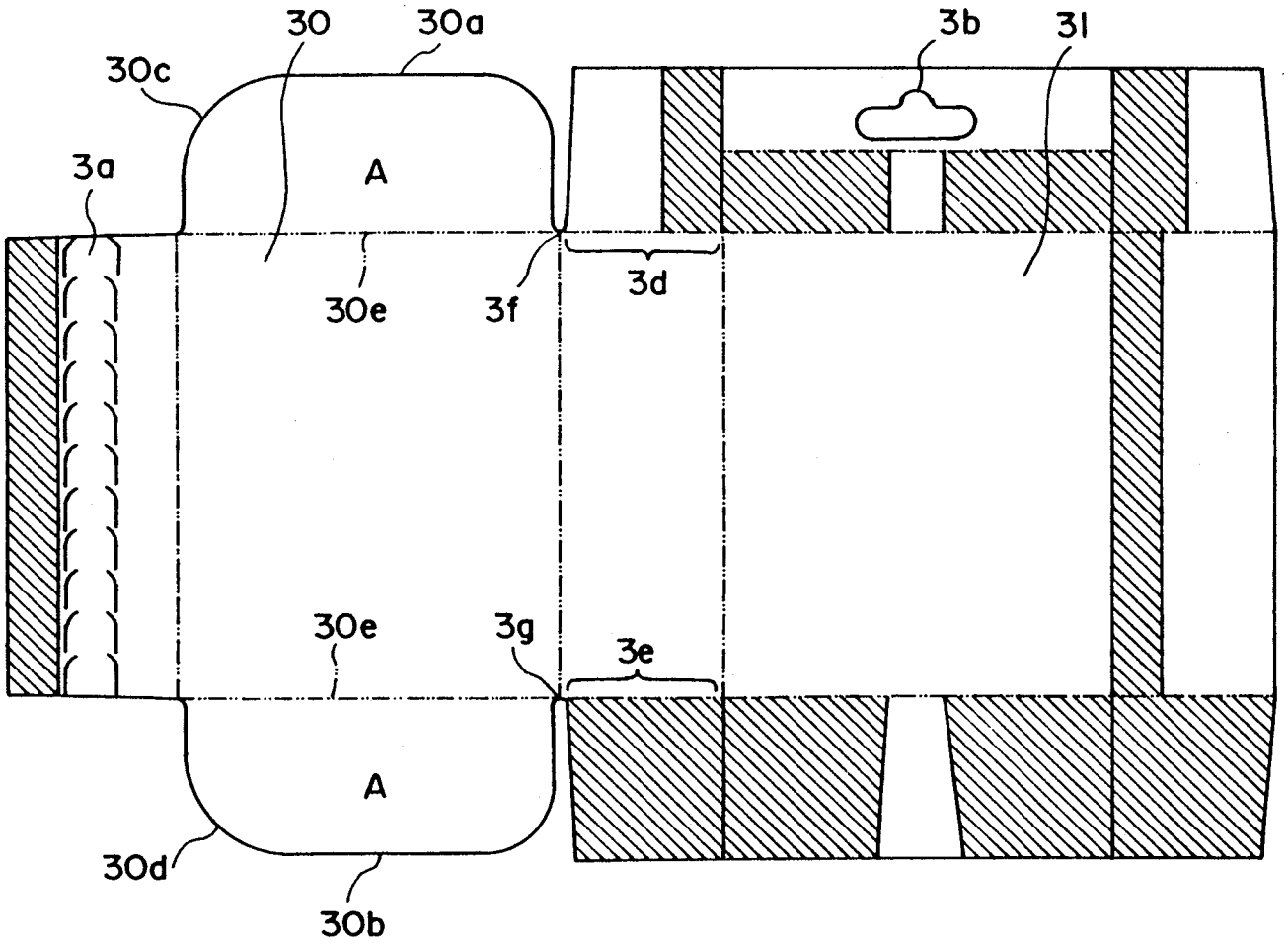
FIG. 3 is a development elevation of the box constituting the ink jet cartridge package.
Figure 4:
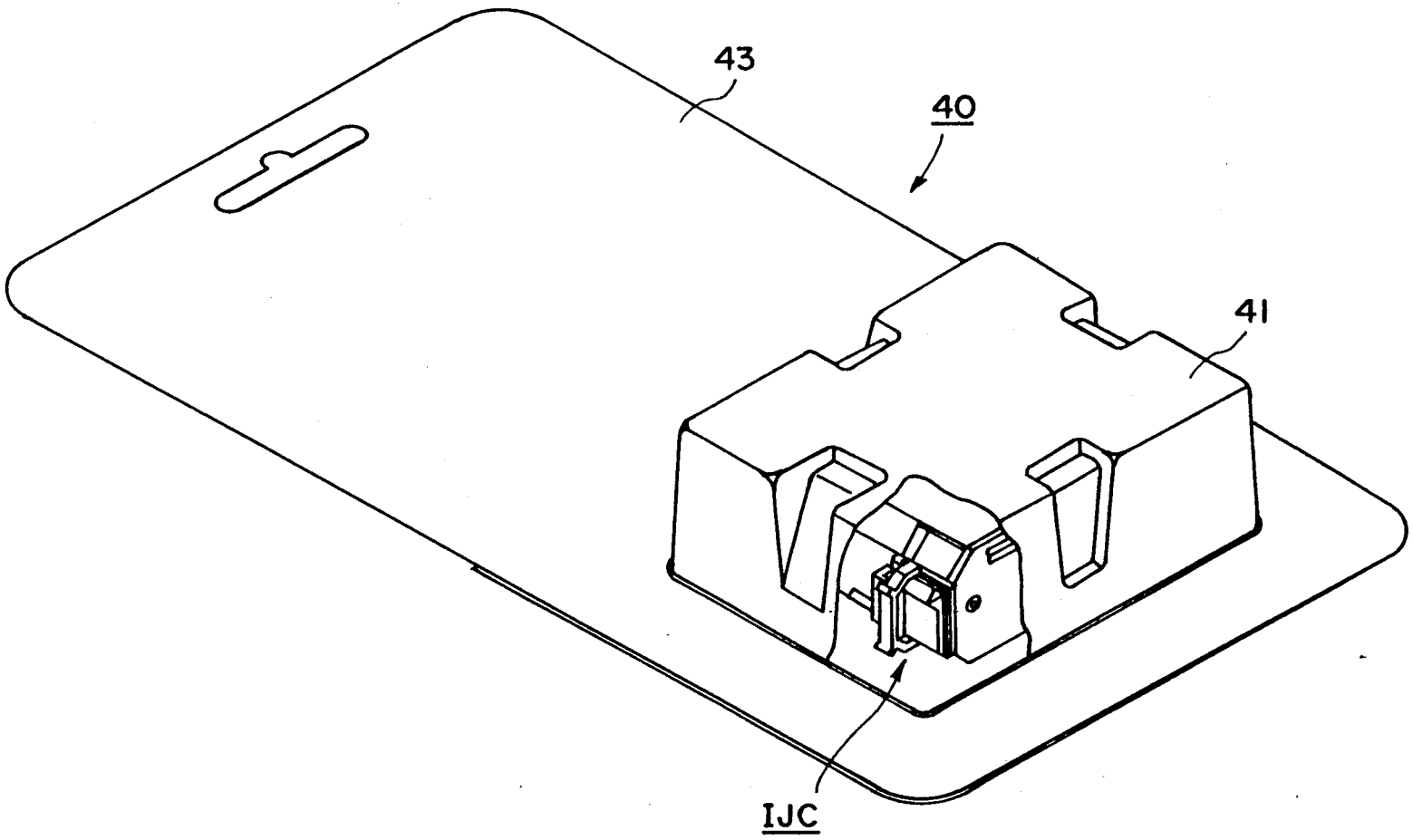
FIG. 4 is a perspective view of a conventional ink jet cartridge package from which the present invention starts.

The casing 1 and the covering member 2 cooperating to accommodate the cartridge are contained in a box 3 for the purpose of protecting the damage to the cartridge during the distributing transportation, for the purpose of better display during sale, for the purpose of easy opening and also for the purpose of easing the impact to the cartridge during the opening action. FIG. 3 is a development elevation of the box 3.

The box 3 has an outer rectangular parallelepiped configuration. It is provided with a zipper portion 3*a* for opening the box 3 in a long side surface and is provided with a hook 3*b* for display at a short side surface. When the zipper portion 3*a* is removed, the box 3 is separated into a cap 30 and the casing 31. The hook 3*b* is at the casing 31 side. The casing 31 is manufactured by bonding, and therefore, it is sufficiently strong when the package is displayed.

Referring to FIG. 3, the hatched portion is the bonding area. It should be noted that the bonding area is only in the casing 31 side. In FIG. 3, an area A is not bonded even when the box is constituted. Therefore, when the zipper portion is removed, the area A is in the free state, so that the box 3 can be easily and safely opened by simply removing the zipper portion without any other action which may cause impact (the impact which may be caused by removing the cap and/or by peeling the bonded area). Since the area A is free, the area A is effective to ease the external impact by the contact between the casing 1 and the free area A, even if the casing 1 is moved in the box 3 during transportation or the like.

At interfaces 3*d* and 3*e* between the cap 30 and the casing 31 of the box 3, perforations are formed to permit the box 3 to be expanded when the box 3 is opened, as shown in FIG. 1, if the perforated portions are torn. Since the box can be expanded into a flat member, the description of the way of handling the cartridge, for example, can be printed inside the box 3. The conventional necessity for the instruction sheet or sheets or the like in the package can be eliminated, and therefore, the cost can be reduced.

As shown in FIG. 3, the box 3 of this embodiment has rounded corners at the free ends 30*a* and 30*b* of the area A. This permits smooth opening of the box without interference of the area A to the other portion of the box. The curvature of the radius of the rounded portions 30*c* and 30*d* adjacent the zipper portion 3*a* is larger than that of the rounded portions remote from the zipper portion 3*a*, by which the corner having the large radius of curvature is prevented from interfering with the inside wall of the box, when the box is opened. Thus, the operativity when the box is opened is further improved. The point on the rounded portion 30*c* and 30*d* which is most remote from the rotational center 3*f* or 3*g* at the time when the cap 30 is opened, is within a distance which is smaller than the length between the rotational center 3*f* or 3*g* and the short side 30*e*, by which the operativity of the opening action is further improved.

In the box 3, the cartridge is accommodated so that the head portion of the cartridge faces downwardly with respect to the direction of the gravity when the box 3 is displayed in the shop. By accommodating the cartridge in this manner, the presence of the ink adjacent the recording head, particularly the ejection outlets is assured even if the ink is evaporated during long term non-use. Therefore, the ejection failure attributable to the introduction of an air bubble or the like can be suppressed to a significant extent, and therefore, no excessive recovery operation is required upon the initial use immediately after the opening of the box.

The article contained in the package may be an ink cartridge which is detachably mountable to a recording apparatus and which comprises a recording head portion for receiving image formation signals to effect the recording and an integral ink container accommodating the ink to be supplied to the head portion. Another example of the article is an ink container alone.

As described in the foregoing, according to the present invention, the package is provided which is low in cost, has necessary and sufficient durabilities against an the impact or ambient condition change, and is easily opened with good operativity.

While the invention has been described with reference to the structures disclosed herein, it is not confined to the details set forth and this application is intended to cover such modifications or changes as may come within the purposes of the improvements or the scope of the following claims.

What is claimed is:

1. A package for an ink jet cartridge, comprising:

an opaque casing having an accommodating portion for accommodating the ink cartridge;

a covering member including an evaporated aluminum layer and a nylon layer for sealing of an access opening of said casing; and a box having a rectangular parallelepiped configuration for accommodating said casing sealed by said covering member, said box being provided with an opening portion and a hook for display.

2. A package according to claim 1, wherein said box has a folded tongue portion which continues to a side surface having the opening portion and which constitutes a free end.

3. A package according to claim 1, wherein said box is provided with perforations at a short side of a side surface faced to a side having the opening portion.

* * * * *

UNITED STATES PATENT AND TRADEMARK OFFICE

CERTIFICATE OF CORRECTION

PATENT NO. : 5,279,410

DATED : January 18, 1994

INVENTOR(S) : TERUO ARASHIMA, ET AL.

It is certified that error appears in the above-identified patent and that said Letters Patent is hereby corrected as shown below:

COLUMN 1

Line 60, "causes" should read --cause--.

COLUMN 3

Line 5, "day light" should read --daylight--.

COLUMN 6

Line 25, "the" should be deleted.

Signed and Sealed this

Twenty-sixth Day of July, 1994

Bruce Lehman

*Attest:*

BRUCE LEHMAN

*Attesting Officer*

*Commissioner of Patents and Trademarks*